US005619185A

United States Patent [19]

Ferraro

[11] Patent Number: 5,619,185

[45] Date of Patent: Apr. 8, 1997

[54] FLOOD LIGHT LAMP REMOVAL ALARM

[76] Inventor: Joseph C. Ferraro, 123 Toledo St., East Farmingdale, N.Y. 11735

[21] Appl. No.: 537,262

[22] Filed: Sep. 29, 1995

[51] Int. Cl.[6] ..... G08B 13/14

[52] U.S. Cl. ..... 340/568; 340/571; 340/541; 340/506; 340/527

[58] Field of Search ..... 340/568, 541, 340/571, 552, 565, 567, 506, 527

[56] References Cited

U.S. PATENT DOCUMENTS

| | | | |
|---|---|---|---|
| 3,382,494 | 5/1968 | Mahacsek | 340/568 |
| 3,975,627 | 8/1976 | Huber | 362/377 |
| 4,021,679 | 5/1977 | Bolle et al. | 340/562 |
| 4,295,079 | 10/1981 | Otsuka | 315/130 |
| 4,369,435 | 1/1983 | Adachi et al. | 340/506 |
| 4,396,868 | 8/1983 | Watanabe | 315/130 |
| 4,422,068 | 12/1983 | Helft | 340/514 |
| 4,438,431 | 3/1984 | Toyomura | 340/663 |
| 4,700,126 | 10/1987 | Hill | 324/510 |
| 4,812,827 | 3/1989 | Scripps | 340/693 |
| 4,936,789 | 6/1990 | Ugalde | 438/236 |
| 4,980,672 | 12/1990 | Murphy | 340/571 |
| 5,034,659 | 7/1991 | Taniguchi | 315/131 |
| 5,099,177 | 3/1992 | Taniguchi | 315/130 |
| 5,155,474 | 10/1992 | Park et al. | 340/567 |
| 5,160,000 | 11/1992 | Agha et al. | 340/568 |
| 5,168,198 | 12/1992 | Watanabe | 315/130 |
| 5,172,098 | 12/1992 | Leyden et al. | 340/568 |
| 5,266,920 | 11/1993 | Langner | 340/568 |
| 5,293,115 | 3/1994 | Swanson | 340/568 |
| 5,359,325 | 10/1994 | Ford | 340/953 |
| 5,387,909 | 2/1995 | Neel | 340/931 |
| 5,406,129 | 4/1995 | Gilmartin | 307/125 |
| 5,434,558 | 7/1995 | Zeder | 340/568 |

*Primary Examiner*—Jeffery Hofsass
*Assistant Examiner*—Benjamin C. Lee
*Attorney, Agent, or Firm*—Alfred M. Walker

[57] ABSTRACT

The present invention includes a flood light lamp removal alarm for security lights mounted on or near a home, wherein the lights are designed to turn on automatically if a motion detector is triggered and the ambient light level is low. The alarm detects if the lamps are unscrewed or loosened either prior to a burglary or during the attempt. In addition, the alarm also detects if the lights are loosened by natural forces, such as vibrations from passing heavy trucks, etc., abrupt jarring motions, such as foundation loosening, machinary movement, sound, repetitive motions etc. If one or more lamps are loosened, the alarm of the present invention causes the discernable alarm to go on, thereby startling a burglar and alerting the neighbors if a flood light lamp is unscrewed from a security light socket while the switch inside the house is turned on, regardless of whether the lamp is on or off.

12 Claims, 4 Drawing Sheets

FLOOD LIGHT LAMP REMOVAL ALARM

FIELD OF THE INVENTION

The present invention relates to a home security device.

BACKGROUND OF THE INVENTION

Many homeowners have security lights mounted on or near their home. Some of these lights are designed to turn on automatically if a motion detector is triggered and the ambient light level is low. These lights are a deterrent to burglary. Unfortunately, they can be easily defeated if the lamps are unscrewed or loosened either prior to the burglary or during the attempt.

In addition, if the lights are loosened by natural forces, such as vibrations from passing heavy trucks, etc., abrupt jarring motions, such as foundation loosening, machinary movement, sound, repetitive motions etc., then the lamps will also be loosened. Moreover, a loosened lamp would not be noticed during daylight hours.

Various attempts have been made to provide lamp failure devices. U.S. Pat. No. 5,099,177 of Taniguchi discloses a lamp circuit with disconnected lamp detecting device. U.S. Pat. No. 4,980,672 of Murphy discloses an overhead socket smoke detector with theft alarm.

U.S. Pat. Nos. 4,396,868 and 5,168,198 of Watanabe discloses a lamp circuit with disconnected lamp detecting device and a lamplight failure detection system respectively. U.S. Pat. No. 5,359,325 of Ford discloses an automatic monitoring system for airfield lighting systems.

Furthermore, U.S. Pat. No. 5,387,909 of Neel discloses a lamp sensing system for traffic light. In addition, U.S. Pat. No. 5,034,659 of Taniguchi describes a lamp circuit with a disconnected lamp detecting device. U.S. Pat. No. 4,700,126 of Hill shows a vehicular lamp circuit tester.

Moreover, U.S. Pat. No. 4,438,421 of Toyomura discloses an electronic device having a warning means and U.S. Pat. No. 4,295,079 of Otsuka describes a lamp circuit with a disconnected lamp detecting device. U.S. Pat. No. 4,422,068 of Helft discloses an intrusion alarm system for preventing actual confrontation with an intruder.

In addition, U.S. Pat. No. 3,975,627 of Huber shows a burglar-proof guard for light bulbs and U.S. Pat. No. 4,936,789 of Ugalde shows a method and apparatus for preventing the theft of a fluorescent lamp and ballast transformer.

Among other prior art includes U.S. Pat. No. 4,812,827 of Scripps which describes a detector and light assembly and U.S. Pat. No. 5,406,129 of Gilmartin which describes a flashing locator switch control with built-in lamp operation test.

While the prior art teaches a variety of methods for failed lamp detection and even an alarm for detecting removal of a smoke detector from a socket, the applications are very specialized. The present invention sets off an audible or silent alarm when an ordinary bulb or flood lamp is loosened or removed from the socket of a single or multi-lamp security light fixture. Furthermore, the alarm remains on or otherwise indicates that an incident had occurred even if the lamp is immediately retightened in its socket. This action is achieved using inexpensive switch elements and electronic subsystems consistent with the product cost limitations dictated by this consumer market.

OBJECTS OF THE INVENTION

It is therefore an object of the present invention to provide a home security device which detects unwarranted removal of a flood light lamp.

It is yet another object to provide a flood light lamp removal alarm which is a deterrent to burglary.

It is yet a further object to provide a flood light lamp removal alarm which is activated if the lamps are unscrewed or loosened, either prior to a burglary or during an attempt to disable the flood light assembly.

It is yet another object to provide a flood light lamp removal alarm which detects if lights are loosened by natural forces, such as vibrations from passing heavy trucks, etc., abrupt jarring motions, such as foundation loosening, machinary movement, sound, repetitive motions etc.

It is yet another object to provide a flood light lamp removal alarm which causes a discernable alarm to go on, thereby startling a burglar and alerting the neighbors if a lamp is unscrewed from a security light.

It is yet another object to improve over the disadvantages of the prior art.

SUMMARY OF THE INVENTION

In keeping with these objects and others which may become apparent, the present invention includes a flood light lamp removal alarm for security lights mounted on or near a home, wherein the lights are designed to turn on automatically if a motion detector is triggered and the ambient light level is low. The alarm detects if any of the flood light lamps are unscrewed or loosened, either prior to a burglary or during the attempt to disable the flood light assembly.

In addition, the alarm also detects if the lights are loosened by natural forces, such as vibrations from passing heavy trucks, etc., abrupt jarring motions, such as foundation loosening, machinary movement, sound, repetitive motions etc.

If one or more lamps are loosened, the alarm of the present invention causes the discernable alarm to go on, thereby startling a burglar and alerting the neighbors if a flood light lamp is unscrewed from a security light while the switch inside the house is turned on, regardless of whether the lamp is on or off.

A housing is provided for the alarm, wherein the housing contains control circuitry and a discernable alarm, such as an audio alarm, for example, an electronic sound generator. The electronic sound generator may be an oscillator or siren type of sound generator, or either a magnetic or piezoelectric sound transducer or loudspeaker.

The trigger for the alarm is preferably a detection device with a snap action switch, which is activated by an insulating rod. The insulating rod is physically pushed by the lamp base when the lamp base is properly screwed into the socket. The alarm is activated when the detection rod is pushed away by the restoring spring in the switch.

In the alternate, the snap action switch can be replaced by a photodetector in the lamp socket which detects the proper position of the lamp.

The alarm is powered by a low voltage DC power supply formed by a transformer connected at one side to a 120 volt AC power supply and on the other side to a diode and capacitor connected to a plurality of switches, such as single pole, single throw (SPST) switches located within the lamp sockets. The switches are wired in parallel so that any of the switches can turn on the alarm, if any bulb is removed in an unauthorized manner.

In an alternate embodiment, the flood light lamp removal alarm may be remotely placed away from the lamp fixture, such as with a wireless communication device.

The lamp sockets may alternately include a compressive switch for detecting the lamps of a flood light lamp fixture. In the compressive switch, contacts are provided such that the contacts close when the lamp is properly screwed into the socket.

Therefore, a simple in-socket switch is provided within each socket, to detect the unwarranted loosening or removal of any flood light lamps of a home security flood light assembly.

DESCRIPTION OF THE DRAWINGS

The present invention can best be understood in conjunction with the accompanying drawings, in which.

DESCRIPTION OF THE PREFERRED EMBODIMENTS

Figure 1:
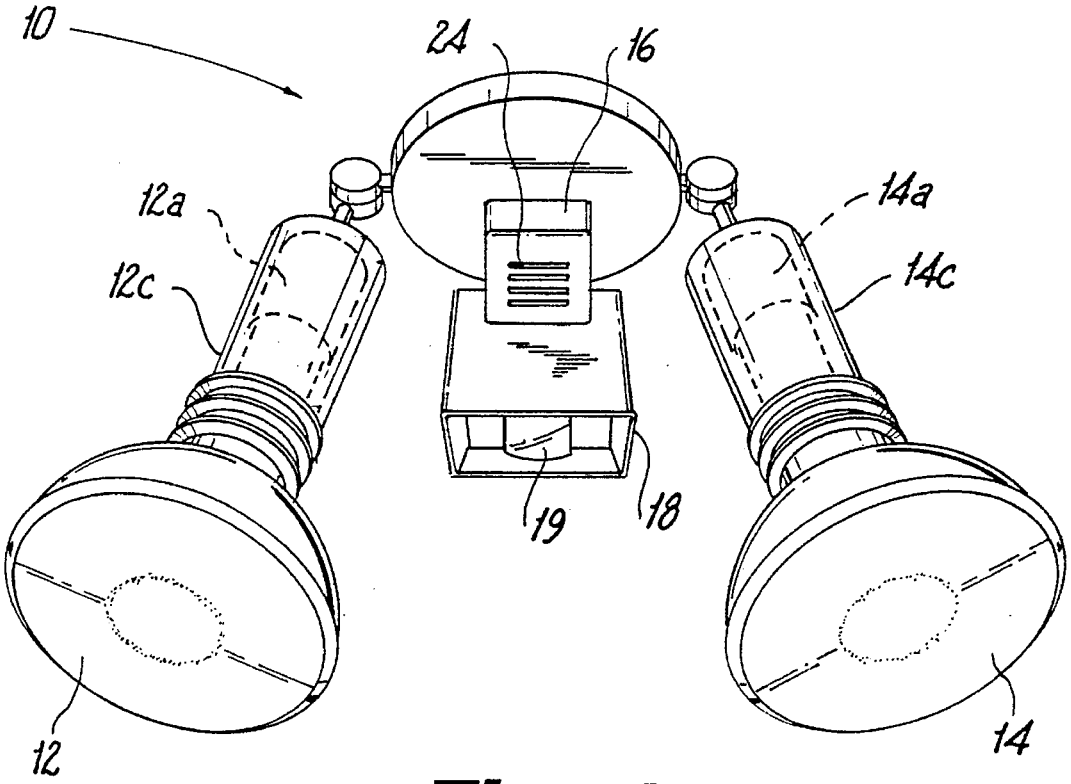
FIG. 1 is a perspective view of the flood lamp/alarm fixture of one embodiment of the present invention.
Figure 2A:
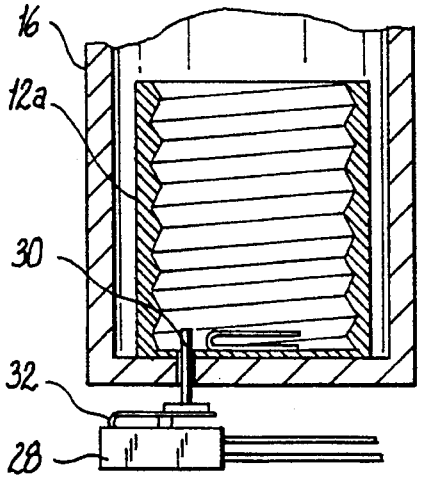
FIGS. 2A and 2B are crossection views of the socket portion of the fixture as in FIG. 1.
Figure 2B:
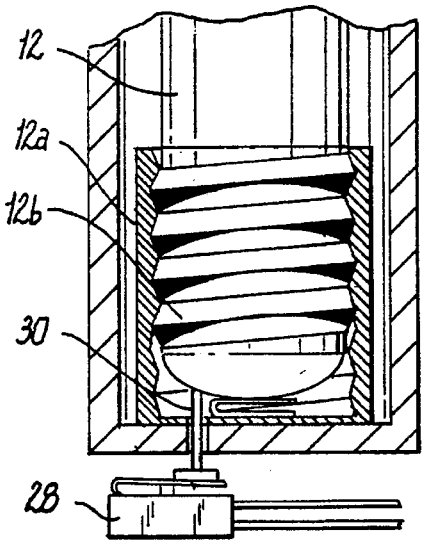
Figure 3:
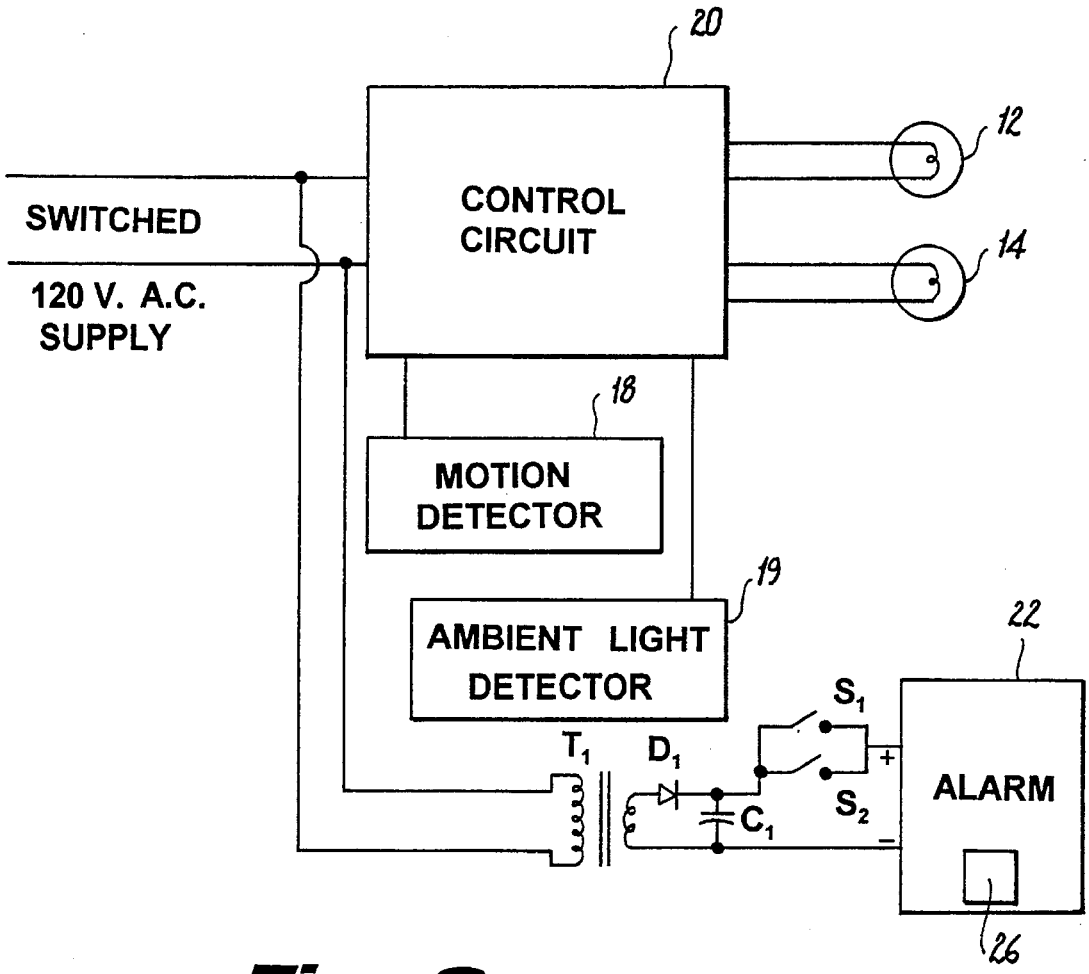
FIG. 3 is an electrical schematic diagram of the present invention as in FIG. 1.

As shown in an embodiment shown in FIGS. 1–3, FIG. 1 shows a two flood lamp security fixture 10 for a pair of flood light lamps 12, 14 screwed into sockets 12*a*, 14*a*. Sockets 12*a*, 14*a* within socket housings 12*c*, 14*c* are connected to alarm control housing 16 and conventional motion detector 18, which detects movement in low light conditions in conjunction with ambient light detector 19.

Fixture 10 appears visibly undetectable since lamp security fixture 10 looks quite ordinary. However, housing 16, which normally contains control circuitry 20, also contains audio alarm 22. Housing 16 may be somewhat larger than normal to accommodate audio alarm 22, and it may have sound escape holes or louvers 24. Audio alarm 22 itself includes electronic sound generator 26, such as an oscillator or siren type of sound generator, and either a magnetic or piezoelectric sound transducer or loudspeaker.

As shown in FIGS. 2A and 2B, a method of lamp detection is employed to trigger audio alarm 22. One method is to equip each lamp socket 12*a*, 14*a* with miniature snap-action switch 28, which switch 28 is activated by an insulating rod 30, which insulating rod 30 is physically pushed by the lamp base 12*b* or 14*b*, of lamp 12 or lamp 14, into a first predetermined position, when lamp 12 or lamp 14 is properly screwed in sockets 12*a* or 14*a*.

Detection rod 30 is pushed away from the first predetermined position to a second predetermined position by restoring spring 32 in snap-action switch 28, if lamp 12 or lamp 14 is loosened or removed, such as shown in FIG. 2A with respect to lamp 12.

In this configuration in FIG. 2A, switch 28 is in the "ON" position and audio alarm 22 is turned on, regardless of lamp 12 itself being "on" or "off".

in FIG. 2B however, detection rod 30 is pushed down by lamp 12 so that switch 28 is turned off. Snap-action switch 28 can be replaced by a photodetector in the socket housing 12*c* or 14*c* that detects the proper position of lamp 12 or lamp 14.

Another alternative retains detection rod 30 but wherein detection rod 30 actuates either a hall-effect sensor or an electronic photodetector switch, either of which is shaped like snap-action switch 28. In any event, the detection of the proper positioning of lamp 12 or 14 in their respective sockets 12*a*, 12*b* is made at this location.

FIG. 3 shows a block diagram of the security lamp system with a wiring diagram for adding the alarm feature. Here, alarm 22 is wired directly to the switch 120 volt AC line that feeds the entire fixture. Transformer T1, diode D1, and capacitor C1 form a small low voltage DC power supply to power alarm 22. The voltage output is preferably from 5 to 12 volts as appropriate.

Control circuit 20 of the security lamp system also has a DC power supply internally which is used to power alarm 22 instead of transformer T1, diode D1 and capacitor C1 if the feature is integrated with the security lamp feature.

S1 and S2 describe two single pole single throw (SPST) switches normally on snap-action switches, such as switch 28, located in lamp socket housings 12*c*, 14*c*. Switches S1, S2 are wired in parallel so that either switch S1 or switch S2 can turn alarm 22 on if either lamp 12 or lamp 14 is unscrewed or loosened from lamp socket 12*a* or lamp socket 14*a*. For a single lamp, only one switch is used. For any number of multiple lamps, there is generally one switch per socket and they are generally wired in parallel.

The homeowner can easily change lamp 12 or lamp 14 without triggering alarm 22 by simply switching the security lamp off from a conventional on-off switch inside the house.

In an alternate embodiment, shown in FIGS. 4–7, alarm 122 for lamps 112, 114 is remotely placed away from security lamp fixture 110. This necessitates the use of a cable connection 140 from alarm 122 to security lamp fixture 110, as in FIG. 4, unless an alternate wireless communication scheme is used from fixture 110 to alarm 122. The latter can be a radio frequency or infrared communication link from the sensors in lamp fixture 110 to the alarm triggering circuit.

Another "wireless" option is to use the power wiring itself (house 120 V AC wiring) as the signalling connection. A typical sophisticated encoding scheme that puts a signal carrier onto the power wiring is manufactured by ECHELON Corporation.

In the remaining description, cable connection 140 is described. Cable connection 140 is preferably hidden or armored so that it would be difficult to tamper with it.

Two alternate powering schemes are shown for remote alarm 122. One is an AC connection through a wall mounted alarm defeat switch 152 inside the house.

A second approach is to feed low voltage DC from inside the house either provided by battery pack 154 or an AC connected power supply. This alternative simplifies wiring to alarm 122 since only low voltage DC need be wired, as a safety consideration. This latter alternative has alarm defeat switch 152 mounted on the power supply or battery pack 154. In any event, defeat switch 152 is required to permit the homeowner to change lamps 112, 114 in fixture 110 without triggering alarm 122.

Figure 6:
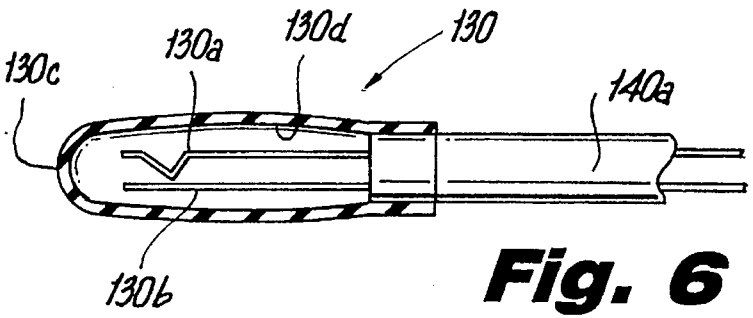
FIG. 6 is a closeup view of the compressive switch element as in FIG. 4.
Figure 5:
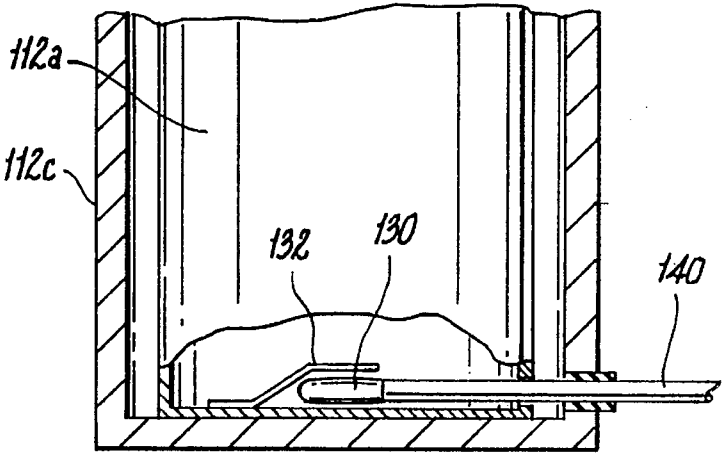
FIG. 5 is a crossection view of the system as in FIG. 4.

FIG. 5 shows a crossection of an ordinary lamp socket 112*a* of housing 112*c* modified to include a compressive switch lamp screw-down detection element 130. A hole is drilled through the side of socket housing 112*c* and through the lamp screw socket connector 112*a* at the level of the center spring contact 132. Compressive switch element 130, as in FIG. 6, is slid through this access hole placing switch element 130 directly under spring contact 132. Switch connecting cable 140 is then sealed with an elastomeric sealant around its entry to socket housing 112*c*.

FIG. 6 reveals that compressive switch element 130 is simply a spring contact 130*a* and a rigid contact 130*b* encased in an elastomeric bulb 130*c*, which is sealed around contact housing 130*d* and sensor cable insulation 140*a*. The material of bulb 130*c* as well as cable insulation 140*a* in the vicinity of the lamp socket 112*c* must be high temperature insulators such as silicone material.

The operation of the compressive switch 130 is such that contacts 130*a*, 130*b* are closed when lamp 112 is properly screwed into socket 122*a*. Contacts 130*a*, 130*b* open and break an electrical circuit if lamp 112 is loosened or removed. Although switch 130 itself in an SPST normally open type, in operation with lamp 112 screwed in, switch 130 will be in the "ON" position.

Figure 7:
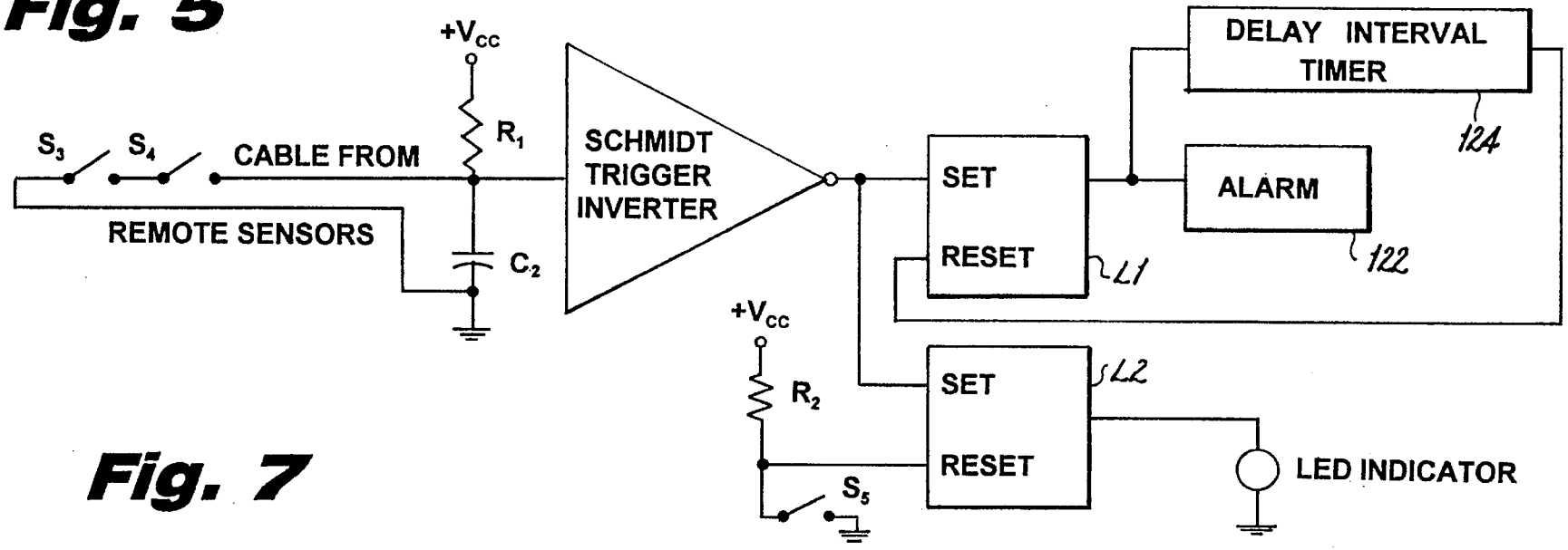
FIG. 7 is an electrical schematic of the alarm triggering as in FIG. 4; and, FIGS. 8 is a block diagram of an automatic dialer interface for the present invention as in FIG. 1 or FIG. 4.

Therefore, if multiple switches 130 are used to detect loosening in multi-lamp fixtures, they are preferably wired in series as shown in FIG. 7, such as S3 and S4. In this way if any one lamp 112 is loosened, or if the cable is cut, alarm 122 will be triggered.

FIG. 7 shows an alarm triggering circuit with several features. It is assumed that sensor switches S3, S4 are of the compressive switch type. A simple circuit change easily accommodates one or more switches S3, S4, wired in parallel of the type shown in FIGS. 2 and 3.

The triggering circuit detects any attempted tampering even if lamp 112 is quickly screwed back in. Alarm 122 stays on for a period of time determined by the delay interval timer 124 and a tell-tale indicator lamp or light emitting diode (LED) remains on until manually turned off by the homeowner, indicating that alarm 122 had been triggered.

There are many possible implementations of this control scheme. FIG. 7 shows one embodiment. The circuit consisting of resistor R1, capacitor C2 and a "schmidt" trigger inverter I form a signal conditioning circuit for the two sensor switches, S1 and S2. The inverter I is preferably an SN74HC14 type from Texas Instruments, for example. Resistor R1 can bias the input to the inverter I "HIGH", except for the fact that S1 and S2 are usually closed, thereby shorting this input to ground.

Capacitor C2 is used to "quiet" the circuit, making it more immune to minor disturbances, such as lightning or power interferences that may disturb long sensor cable 140. If lamp 112 is loosened, one of the switches opens, thereby permitting resistor R1 to pull up the inverter I input. Although capacitor C2 will slow this transition, the use of a "schmidt" trigger type of inverter insures a crisp "HIGH" to "LOW" transition at the output of inverter I, which sets latches L1 and L2, since these are of the "low edge triggered" variety.

Even if the input condition goes away, e.g. lamp 112 is quickly screwed back in, latches L1, L2 remain set. Latch L1 immediately sets off alarm 122 for a period determined by delay interval timer 124 which then resets latch L1. However, latch L2 stays on, powering the LED until the user manually presses the momentary SPST switch S5 to reset the latch L2, thereby turning the LED off. The LED and switch S5 are preferably in an accessible location, such as on an indoor panel or power supply.

Figure 4:
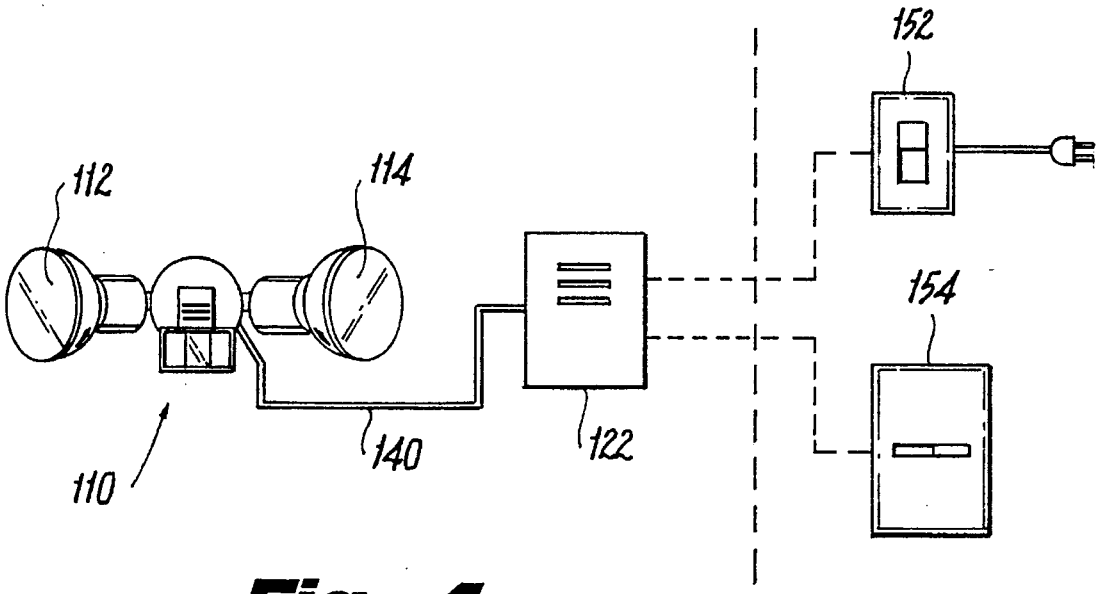
FIG. 4 is a perspective view of an alternate remote alarm system.
Figure 8:
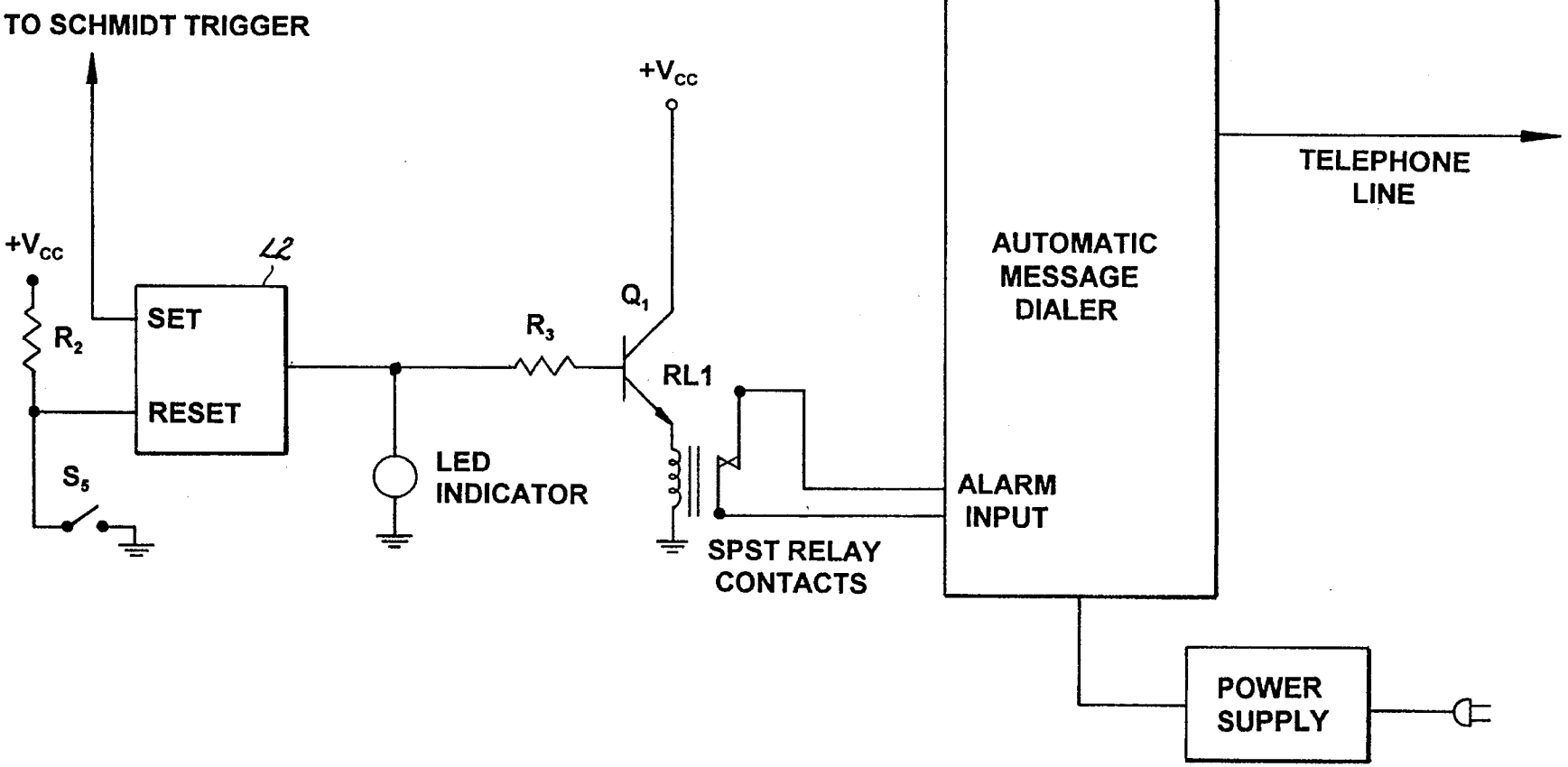

FIG. 8 shows an automatic dialing feature for either of the embodiments in FIG. 1 or FIG. 4. Stand-alone automatic message dialers have been commercially available for some time. A model 49-434 from Radio Shack is currently available. By adding automatic dialer 301 to the basic alarm circuit shown in FIG. 7, the flood lamp removal alarm 122 is able to automatically dial up to three phone numbers automatically. The unit is attached to its own power supply and to the telephone line. It has a numeric keyboard for entering the phone numbers and a digital recorder with built-in microphone for recording a short phone message to be sent.

FIG. 8 shows the interface circuitry required to connect dialer 301 to the flood light alarm removal alarm 22. The dialer input is set up to monitor "contact closure". A pair of normally closed single pole contacts (SPST) on relay RL1 are used to trigger the automatic message dialer 301. Relay RL1 is driven by an emitter-follower amplifier consisting of a transistor (Q1), such as an NPN transistor and a base resistor (R3). Relay RL1 is energized whenever the LED indicator is turned on by latch L2. This, in turn, causes contacts 130*a*, 130*b* to open, thereby triggering automatic message dialer 301. By turning off audible alarm 122, or eliminating it, flood lamp removal alarm 122 can function as a "silent alarm" dialing the appropriate authorities.

Other types and models of automatic message dialers are also available. Some may not require the relay as part of the interface. Also, the entire function of the stand-alone dialer can be built into the flood lamp removal alarm.

The above examples are illustrative of the concept described in the preferred embodiments. However, other embodiments may be made to the present invention for a flood light lamp removal alarm.

I claim:

1. A flood light lamp removal alarm assembly for home security flood light fixtures having at least one socket accommodating at least one flood light lamp, said socket connected to a power supply for the lamp, the fixture having a low ambient light detector and a motion detector, wherein the assembly detects unwarranted unscrewing of the flood light lamp therefrom, comprising:

a housing containing a perceptible alarm; a means for detecting removal of the lamp, said means comprising the lamp socket having a physical condition sensor therein, which physical condition sensor is inactivated when said lamp is properly screwed in said socket, said physical condition sensor being activated when said lamp is loosened or removed from said socket;

said sensor comprising a switch mounted in the bottom of said socket positioned in such a manner that when said lamp is properly screwed into said socket said switch is depressed in the closed position;

electrical circuit means connected to said switch for triggering said alarm when said switch is released as a result of loosening or removal of said lamp, said alarm remaining inactivated as long as said switch remains depressed by said lamp, and said electrical circuit means including latch means for maintaining said alarm in the triggered state when said lamp is screwed back into said socket alter said alarm is triggered and said switch is depressed;

means for slowing down the triggering of said alarm to immunize said electrical circuit from minor power disturbances and lightning; and reset means for permitting said electrical circuit to be reset after an alarm is triggered; wherein said slowing down means comprises a resistor, a capacitor and an inverter; said resistor biasing the input to said inverter to a "HIGH" condition except when said switch is closed, thereby shorting the input to ground, wherein said capacitor makes said electrical circuit immune to said minor disturbances, and if said lamp is loosed, said switch opens, thereby causing said resistor to pull up the input of said inverter, and said inverter responsive to said pull up for setting said latch means; said latch means responsive to said setting for activating said alarm in said housing until reset by said reset means.

2. The flood light lamp removal alarm as in claim 1 wherein the perceptible alarm comprises an electronic sound generator.

3. The flood light lamp removal alarm as in claim 1 wherein the physical condition sensor comprises a snap action switch containing a movable detection rod responsive to movement from a first predetermined off position to a second predetermined on position by a restoring spring in said switch, when said lamp is loosened or removed.

4. The flood light lamp removal alarm as in claim 3 wherein said detection rod actuates a hall-effect sensor.

5. The flood light lamp removal alarm as in claim 1 wherein said perceptible alarm is wired directly to a conventional 120 volt AC power supply that feeds power to the fixture, wherein further the power supply is reduced to a low voltage by a low voltage DC power supply to power the alarm.

6. The flood light lamp removal alarm as in claim 5 wherein said low voltage DC power supply includes a transformer connected to a diode, a capacitor, and at least one single pole single throw (SPST) switch connected to the lamp socket.

7. The flood light lamp removal alarm as in claim 1 wherein said perceptible alarm is remotely placed from the security lamp fixture by a connection from said alarm to the security lamp fixture.

8. The flood light lamp removal alarm as in claim 7 wherein said connection is a cable connection.

9. The flood light lamp removal alarm as in claim 7 wherein said connection is a wireless communication link.

10. The flood light lamp removal alarm as in claim 1 wherein said switch comprises a spring contact and a rigid contact sealed in a bulb within said socket, wherein further said spring contact and said rigid contact close when a lamp is properly screwed into the at least one socket, and said contacts open and break an electrical circuit if the at least one flood light lamp is loosened or removed.

11. The flood light lamp removal alarm as in claim 10 further comprising a plurality of sockets and compressive switch elements, each said compressive switch located within a lamp socket, said compressive switch elements wired in series.

12. A flood light lamp removal alarm assembly for home security flood light fixtures having a plurality of sockets each of which accommodates one flood light lamp, said sockets connected to a power supply for said lamps, the fixtures having low ambient light detectors and motion detectors, wherein the assembly detects unwarranted unscrewing of a flood light lamp therefrom, comprising:

a housing containing a perceptible alarm;

a means for detecting removal of a lamp, said means comprising a physical condition sensor in each socket, the condition sensors being connected in series and being inactivated when all the lamps are properly screwed in their sockets, a physical condition sensor being activated when a lamp in its socket is loosened or removed;

each said physical condition sensor comprising a compressive switch lamp screw-down detection element having a spring contact and a rigid contact, sealed in a bulb, said spring contact and said rigid contact closing when a lamp is properly screwed into its socket, and said contacts open and break an electrical circuit when a lamp in its socket is loosened or removed;

said series connected compressive switch elements being connected to a circuit including a resistor, a capacitor and an inverter forming together a signal conditioning circuit for said plurality of switches, said resistor biasing the input to said inverter to a "HIGH" condition except when said switches are closed, thereby shorting the input to ground, wherein said capacitor makes said circuit immune to minor disturbances, and if a lamp is loosened, a corresponding one of said switches opens, thereby causing said resistor to pull up the input of said inverter, and said inverter responsive to said pull up for setting a latch, said latch responsive to said setting for activating said alarm in said housing for a period determined by a delay interval timer and responsive to the end of said period for resetting said latch.

* * * * *